US011849268B2

(12) United States Patent
Song et al.

(10) Patent No.: US 11,849,268 B2
(45) Date of Patent: Dec. 19, 2023

(54) DIGITAL HEARING DEVICE WITH MICROPHONE IN EAR BAND

(71) Applicant: Olive Union, Inc., Seoul (KR)

(72) Inventors: Myung Geun Song, Seoul (KR); Yoon Soo Kim, Seoul (KR); Dong Hyun Lee, Seoul (KR); Jungkun Choi, Seoul (KR)

(73) Assignee: Olive Union, Inc., Seoul (KR)

( * ) Notice: Subject to any disclaimer, the term of this patent is extended or adjusted under 35 U.S.C. 154(b) by 118 days.

(21) Appl. No.: 17/721,390

(22) Filed: Apr. 15, 2022

(65) Prior Publication Data

US 2023/0308813 A1 Sep. 28, 2023

(30) Foreign Application Priority Data

Mar. 24, 2022 (KR) ..... 10-2022-0036776

(51) Int. Cl.
*H04R 25/00* (2006.01)
*H04R 25/02* (2006.01)
*H04R 1/10* (2006.01)

(52) U.S. Cl.
CPC ..... *H04R 25/407* (2013.01); *H04R 25/02* (2013.01); *H04R 25/405* (2013.01); *H04R 25/43* (2013.01); *H04R 25/554* (2013.01); *H04R 25/607* (2019.05); *H04R 1/1025* (2013.01)

(58) Field of Classification Search
CPC ..... H04R 1/02; H04R 1/026; H04R 1/406; H04R 1/30; H04R 2201/003; H04R 1/2876; H04R 1/2884; H04R 1/34; H04R 1/342; H04R 1/345; H04R 19/005; H04R 19/016; H04R 19/04; H04R 2225/021; H04R 2410/01; H04R 25/02; H04R 25/405; H04R 25/407; H04R 25/48; H04R 25/604
USPC ..... 381/313
See application file for complete search history.

(56) References Cited

U.S. PATENT DOCUMENTS

2023/0063283 A1* 3/2023 Zheng ..... H04R 1/1066

FOREIGN PATENT DOCUMENTS

| | | | |
|---|---|---|---|
| KR | 10-2010-0011984 | A | 2/2010 |
| KR | 10-2017-0030375 | A | 3/2017 |
| KR | 102004460 | B1 | 7/2019 |
| KR | 10-2292926 | B1 | 8/2021 |

* cited by examiner

*Primary Examiner* — Phylesha Dabney
(74) *Attorney, Agent, or Firm* — Bond Schoeneck & King PLLC; David L. Nocilly

(57) ABSTRACT

Disclosed is a digital hearing device with a microphone in an ear band, the digital hearing device including a body; an ear band configured to extend from one side of the body and to surround at least a portion of auricle of a user; a plurality of microphones provided to the ear band at predetermined intervals; an ear head configured to protrude inward from the body and to fit into an ear of the user; and a speaker provided to the ear head and configured to amplify sound received from the plurality of microphones and to deliver the amplified sound to the user.

13 Claims, 11 Drawing Sheets

DIGITAL HEARING DEVICE WITH MICROPHONE IN EAR BAND

CROSS-REFERENCE TO RELATED APPLICATION

This application claims the priority benefit of Korean Patent Application No. 10-2022-0036776, filed on Mar. 24, 2022, in the Korean Intellectual Property Office, the disclosure of which is incorporated herein by reference.

BACKGROUND

1. Field of the Invention

The following description of example embodiments relates to a digital hearing device with a microphone in an ear band, and more particularly, to a digital hearing device with a plurality of microphones in an ear band to improve hearing performance according to a position of a microphone.

2. Description of the Related Art

In the recent years, with the rapid development of biomedical engineering technology, patients who has not received much help from wearing a hearing aid may select and wear an appropriate hearing aid, thereby achieving excellent hearing improvement.

A hearing aid refers to a state-of-the-art medical device that is attached to a body and used at all times among medical devices. Such a hearing aid needs to be continuously maintained according to a change in a hearing ability and requires A/S for a part that is damaged due to moisture and foreign substances in the ear. Therefore, the hearing aid is considered to be one of the most important technologies among biomedical engineering technologies.

The existing hearing aid was in a form of a trumpet-type sound collector, but now usually used in a form of an electric hearing aid that assists amplification of sound. Also, the hearing aid has a bone schematic to be mounted to a mastoid portion, but usually has an airway-type structure. The hearing aid receives sound waves with a microphone, converts the sound waves to electrical vibrations, and expands and coverts the electrical vibrations back to sound waves to be heard by ears using an earphone.

Research on such a hearing aid continues and a currently developed digital hearing aid divides a low frequency and a high frequency of an audible frequency band into several channels and then individually amplifies or controls the channels beyond simply amplifying sound. That is, the digital hearing aid adjusts an amplification only as necessary for each frequency according to a hearing loss of a user. Therefore, compared to the existing amplifier, much clearer sound may be heard with the digital hearing aid.

Korean Patent Registration NO. 10-2004460 relates to a digital hearing device using Bluetooth circuit and digital signal processing and describes technology related to a digital hearing device that may provide a hearing function optimized for a user hearing profile and a hearing aid wearing environment within limited resources of a Bluetooth module using the Bluetooth circuit and a digital signal.

SUMMARY

Example embodiments provide a digital hearing device with a microphone in an ear band, and more particularly, to a digital hearing device with a plurality of microphones in an ear band to improve hearing performance according to a position of a microphone.

Example embodiments provide a digital hearing device with a microphone in an ear band that enables a comfortable mood even in a noisy environment and may also improve amplification effect of sound since a direction of a microphone is positioned behind the auricle when the microphone is seated in an ear of a user by positioning the microphone behind an ear band.

According to an example embodiment, there is provided a digital hearing device with a microphone in an ear band, the digital hearing device including a body; an ear band configured to extend from one side of the body and to surround at least a portion of auricle of a user; a plurality of microphones provided to the ear band at predetermined intervals; an ear head configured to protrude inward from the body and to fit into an ear of the user; and a speaker provided to the ear head and configured to amplify sound received from the plurality of microphones and to deliver the amplified sound to the user.

The body and the ear band may be in a "C" shape, and the plurality of microphones may be provided to the ear band to face different directions when worn.

The plurality of microphones may include a first microphone provided to face the front based on a face of the user when worn and configured to recognize sound from the front; and a second microphone provided to face a back portion or an upper portion of a head of the user when worn and configured to recognize sound from behind.

The digital hearing device may further include a wireless communicator provided to the body and configured to connect to a user terminal through wireless communication; and a controller provided to the body and configured to connect to the user terminal through the wireless communicator and to transmit and receive sound data and a control signal.

The digital hearing device may further include a call-oriented microphone provided to the body and configured to recognize a voice signal of the user when a call is connected using the user terminal.

The controller may be configured to control the plurality of microphones to operate in at least one mode among a hearing aid mode, a call mode, and an earphone mode, and may control the plurality of microphones to be in an ON state when the hearing aid mode is set and control the plurality of microphones to be in an OFF state when the call mode or the earphone mode is set.

The controller may control the plurality of microphones to be in an ON state when a hearing aid mode is set, and may controls one of the plurality of microphones closest to a mouth of the user to be in an ON state and another microphone to be in an OFF state when a call mode is set.

The controller may turn ON/OFF a power of at least one of the plurality of microphones or may adjust an amplification gain of each of the plurality of microphones.

The controller may be configured to set an amplification gain of each of the plurality of microphones according to a control signal delivered through an application of a terminal of the user.

The ear head may be optionally available by combining an open-type or nozzle-type silicone cover.

The ear head may be configured to form at least one leakage hole in a protruding portion of a nozzle-type nozzle portion and to minimize occlusion.

According to another example embodiment, there is provided a digital hearing device with a microphone in an ear band, the digital hearing device including a body; an ear band including a first extension configured to extend from one side of the body and a second extension configured to surround at least a portion of the first extension along auricle of a user; a first microphone provided to the first extension of the ear band; a second microphone provided to the second extension of the ear band; an ear head configured to protrude inward from the body and to fit into an ear of the user; and a speaker provided to the ear head and configured to amplify sound received from the plurality of microphones and to deliver the amplified sound to the user. The body and the ear band may be in a "C" shape.

The first microphone may be provided to face the front based on a face of the user when worn and configured to recognize sound from the front, and the second microphone may be provided to face a back portion or an upper portion of a head of the user when worn and configured to recognize sound from behind.

According to some example embodiments, there may be provided a digital hearing device with a microphone in an ear band that enables a comfortable mood even in a noisy environment and may also improve amplification effect of sound since a direction of a microphone is positioned behind the auricle when the microphone is seated in an ear of a user by positioning the microphone behind an ear band.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Figure 1:
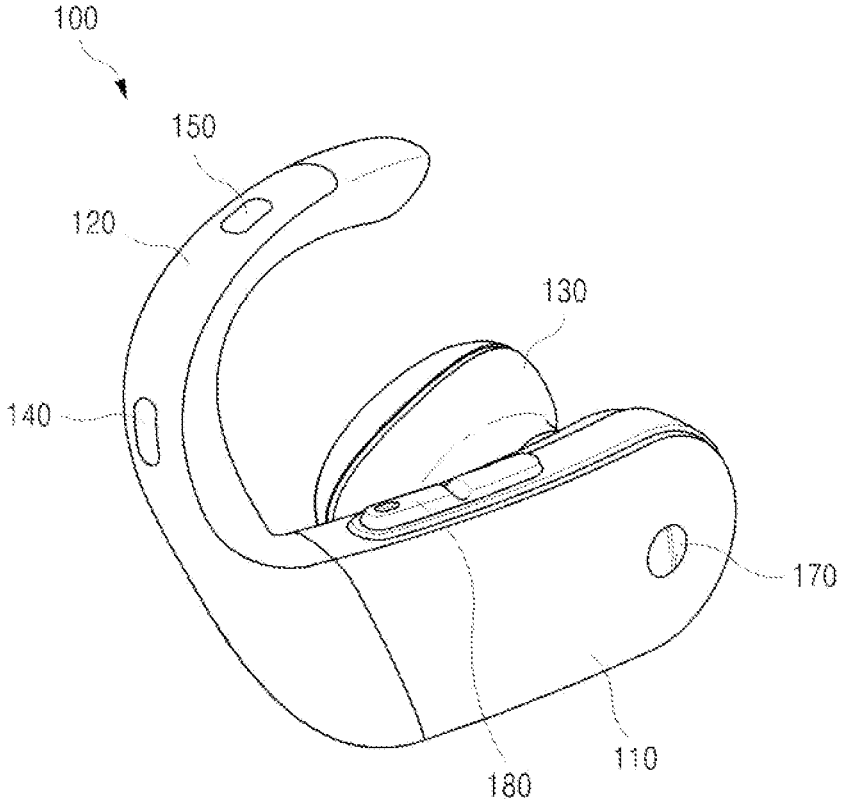
FIG. 1 is a perspective view illustrating a digital hearing device with a microphone in an ear band according to an example embodiment.

Hereinafter, some example embodiments will be described in detail with reference to the accompanying drawings. However, the example embodiments may be variously modified and the scope of the disclosure is not construed as being limited to the example embodiments. Also, some example embodiments are provided to more completely explain the disclosure for one of ordinary skill in the art. Shapes and sizes of components in the drawings may be exaggerated for clearer explanation.

The following example embodiments of the disclosure provide a digital hearing device with a plurality of microphones in an ear band. The example embodiments provide a hearing aid that enables a comfortable mood even in a noisy environment since a direction of a microphone is positioned behind the auricle when a digital hearing device is seated in an ear of a user by positioning a position of the microphone behind an ear band. Here, the microphone is positioned in a highest portion of the ear and a ventilation hole is positioned in a lowest portion of the ear canal. Therefore, since the microphone is provided at the rear, it is possible to improve amplification effect of sound. Since the microphone is far away from a speaker and is less constrained by howling, it is easy to amplify sound.

The example embodiments provide a digital hearing device that may be implemented in various types of products different from an existing typical hearing aid through integration of hardware (H/W) technology and software (S/W) technology and also equipped with various structures, reliability, and a waterproof function.

Figure 2:
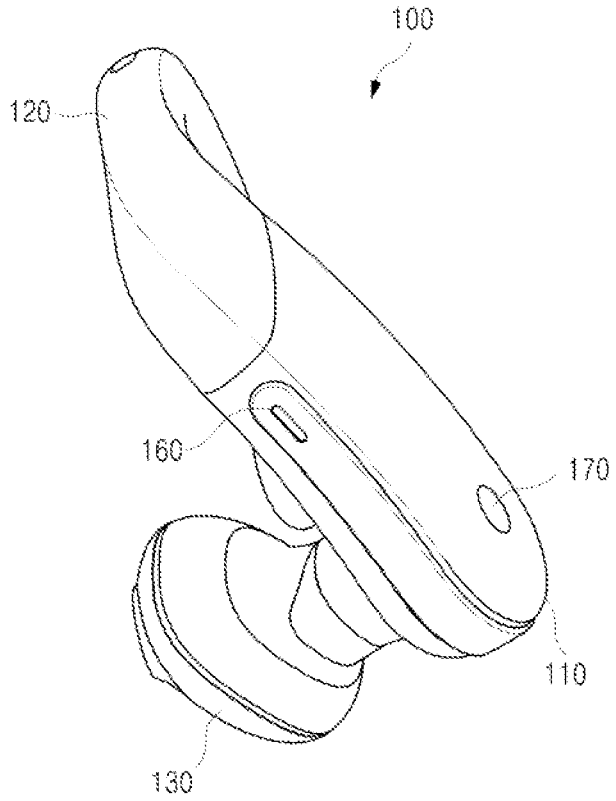
FIG. 2 is a perspective view illustrating a bottom of a digital hearing device with a microphone in an ear band according to an example embodiment.
Figure 3:
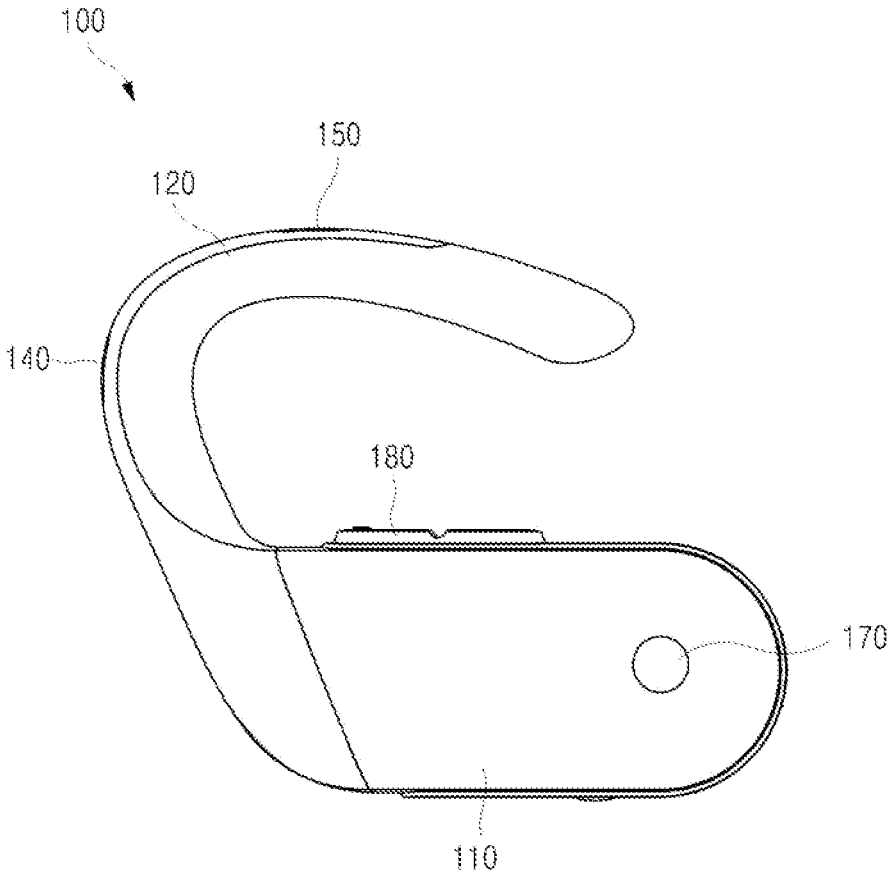
FIG. 3 illustrates a right side of a digital hearing device with a microphone in an ear band according to an example embodiment.
Figure 4:
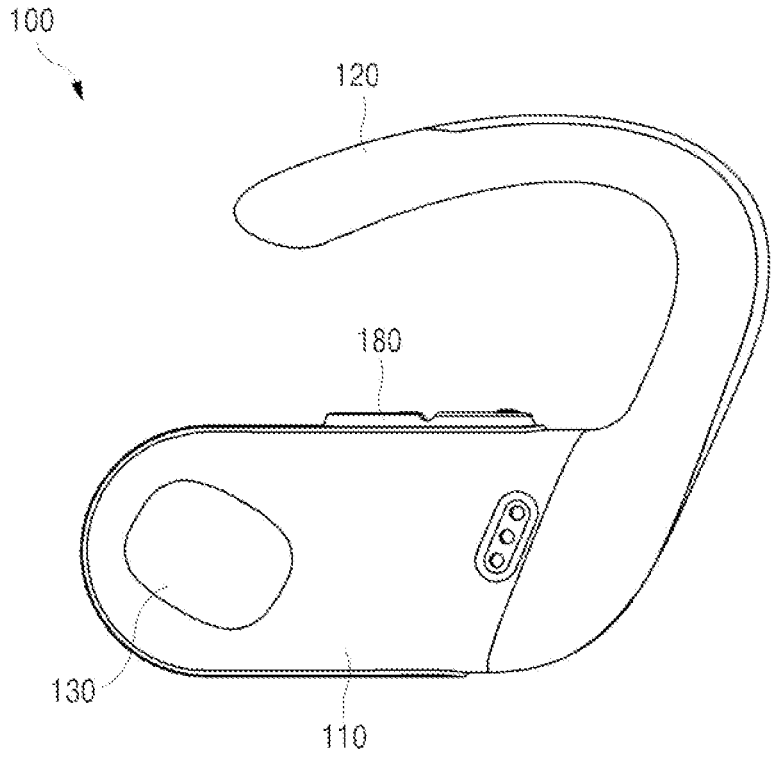
FIG. 4 illustrates a left side of a digital hearing device with a microphone in an ear band according to an example embodiment.

FIG. 1 is a perspective view illustrating a digital hearing device with a microphone in an ear band according to an example embodiment and FIG. 2 is a perspective view illustrating a bottom of a digital hearing device with a microphone in an ear band according to an example embodiment. Also, FIG. 3 illustrates a right side of a digital hearing device with a microphone in an ear band according to an example embodiment and FIG. 4 illustrates a left side of a digital hearing device with a microphone in an ear band according to an example embodiment.

Referring to FIGS. 1 to 4, a digital hearing device 100 with a microphone in an ear band (hereinafter, simply the digital hearing device 100) according to an example embodiment may include a body 110, an ear band 120, an ear head 130, a plurality of microphones 140 and 150, and a speaker. Also, depending on example embodiments, the digital hearing device 100 may further include a call-oriented microphone 160, a wireless communicator, a controller, and a power supplier.

The body 110 may be attached or worn on an ear of a user and may include the wireless communicator, the controller, the power supplier, and the like. The body 110 does not insert into the ear and is in close contact with the ear.

The ear band 120 is configured to extend from one side of the body 110 and to surround at least a portion of the auricle of the user, and the plurality of microphones 140 and 150 is provided to the ear band 120.

For example, the body 110 and the ear band 120 are in a "C" shape and may insert obliquely from an upper side of front to a lower side of rear of the ear of the user and thereby be fastened.

The body 110 and the ear band 120 may be formed by injection of synthetic resin, or may be formed of a metal, for example, stainless steel (STS), aluminum (Al), and titanium (Ti). However, without being limited thereto, the body 110 and the ear band 120 may be formed using various materials.

The ear head 130 is configured in a shape that protrudes inward from the body 110 and is fitted into the ear of the user.

Here, the ear head 130 may be configured as an open type without a protrusion or may be configured as a nozzle type with the protrusion. Also, the ear head 130 may be configured to be optionally available by combining an open-type silicone cover or a nozzle-type silicone cover. Here, the ear head 130 may be configured as an open type and, when the silicone cover is coupled to a lower portion of the ear head 130, the ear head 130 may be determined as an open type or a nozzle type according to a shape of the silicone cover. For example, when the silicone cover including a protrusion is coupled to the ear head 130 configured as the open type, the ear head 130 may be used as the nozzle type.

Here, the ear head 130 may form at least one leakage hole in a protruding portion of a nozzle-type nozzle portion and may minimize occlusion.

Here, the occlusion refers to a phenomenon that, when speaking, vocal cords resonate with the skull including a jawbone and such vibrations are transmitted back to the cartilage of the external auditory meatus. When the hearing aid is worn, vibrations direct toward the eardrum and new sound is generated in a space between the eardrum and the hearing aid and an echo is generated accordingly. According to an example embodiment, the occlusion may be minimized by forming the leakage hole in the protruding portion of the ear head 130.

A number of the plurality of microphones 140 and 150 is at least two and the plurality of microphones 140 and 150 is provided to the ear band 120 at a predetermined interval. Since the microphones 140 and 150 are provided to the ear band 120 to be far away from the speaker, it is easy to amplify sound due to less constraint by howling. Each of the microphones 140 and 150 is configured to receive voice of the user and other sound and may process an external sound signal as electrical voice signal.

The plurality of microphones 140 and 150 may be provided to the ear band 120 such that the plurality of microphones 140 and 150 may face different directions when worn on the ear of the user. In detail, the plurality of microphones 140 and 150 may include the first microphone 140 provided to face the front based on a face of the user when worn and configured to recognize sound from the front and the second microphone 150 provided to face a back portion or an upper portion of a head of the user and configured to recognize sound from behind. Meanwhile, the number of the plurality of microphones 140 and 150 may be at least three without being limited to two.

The digital hearing device 100 according to an example embodiment may further include the call-oriented microphone 160. The call-oriented microphone 160 may be provided to the body 110 and may recognize a voice signal of the user when a call is connected using a user terminal.

For example, the call-oriented microphone 160 may be configured on a lower side of the body 110 toward a mouth of the user and may recognize voice of the user. In particular, the call-oriented microphone 160 may be provided at a position closest to the mouth of the user.

The speaker is provided to the ear head 130 and amplifies sound received from the plurality of microphones 140 and 150 and delivers the amplified sound to the user. Also, the speaker may deliver sound data received through the user terminal to the user.

Meanwhile, the digital hearing device 100 according to an example embodiment may function as a wireless earphone through interaction with the user terminal, in addition to a hearing aid function.

The user terminal used herein may include, for example, a mobile phone, a smartphone, a laptop computer, a digital broadcasting terminal, a personal digital assistant (PDA), a portable multimedia player (PMP), a slate PC, a tablet PC, an ultrabook, a wearable device (e.g., a smartwatch, a smart glass, and a head mounted display (HMD)), and the like.

The wireless communicator is configured to be built in the body 110 and to connect to the user terminal through wireless communication. That is, the wireless communicator may be configured to transmit and receive wireless signals to and from the user terminal in a communication network according to wireless Internet technologies.

The wireless Internet technologies include, for example, Wireless LAN (WLAN), Wireless-Fidelity (Wi-Fi), Wi-Fi Direct, Digital Living Network Alliance (DLNA), Wireless Broadband (WiBro), World Interoperability for Microwave Access (WiMAX), High Speed Downlink Packet Access (HSDPA), High Speed Uplink Packet Access (HSUPA), Long Term Evolution (LTE), Long Term Evolution-Advanced (LTE-A), and the like. The wireless communicator may transmit and receive data according to at least one wireless Internet technology in the range that includes Internet technology not listed above.

Meanwhile, the wireless communicator may perform short range communication. As for short range communication technology, at least one of Bluetooth, Radio Frequency Identification (RFID), Infrared Data Association (IrDA), Ultra Wideband (UWB), ZigBee, Near Field Communication (NFC), Wi-Fi, Wi-Fi Direct, and Wireless Universal Serial Bus (USB) technologies. However, they are provided as examples only and the wireless communicator may receive data from a mobile terminal through short range communication technology not listed above.

As described above, the wireless communicator may receive sound data from a mobile terminal through short range communication. However, without being limited thereto, the wireless communicator may also receive sound data from the user terminal through wireless Internet technology.

The controller may be configured in the body 110 and may be implemented to control the overall operation of components. The controller may amplify sound received from the plurality of microphones 140 and 150 and deliver the amplified sound to the user. Also, the controller may transmit and receive sound data and a control signal through connection to the user terminal through the wireless communicator.

In particular, the controller may control the plurality of microphones 140 and 150 to operate in at least one mode among a hearing aid mode, a call mode, and an earphone mode. For example, when the hearing aid mode is set, the controller may control the plurality of microphones 140 and 150 to be in an ON state. When the call mode or the earphone mode is set, the controller may control the plurality of microphones 140 and 150 to be in an OFF state. In this case, a call function may be used using the separately configured call-oriented microphone 160.

As another example, when the hearing aid mode is set, the controller may control the plurality of microphones 140 and 150 to be in an ON state. When the call mode is set, the controller may control one of the plurality of microphones 140 and 150 closest to a mouth of the user to be in an ON state and another microphone to be in an OFF state. For example, the first microphone 140 provided to face the front based on a face of the user when worn and configured to recognize sound from the front may be in an ON state, the second microphone 150 provided to face a back portion or an upper portion of a head of the user when worn and configured to recognize sound from behind may be in an OFF state, and the call function may be used using the first microphone 140.

As described above, the controller may turn ON/OFF a power of at least one of the plurality of microphones 140 and 150, and may adjust an amplification gain of each of the plurality of microphones 140 and 150.

Here, the controller may set an amplification gain of each of the plurality of microphones 140 and 150 according to a control signal delivered through an application of a terminal of the user. That is, the user may set an amplification gain for each of the plurality of microphones 140 and 150 by setting an application in the user terminal and then executing the application. The controller may receive such a control signal and may set the amplification gain of each of the microphones 140 and 150.

The power supplier is supplied with external power/internal power and supplies power necessary for an operation of each of components under control of the controller. The power supplier may include a battery and the battery may be a built-in battery configured to be rechargeable. However, it is provided as an example only.

Also, the digital hearing device 100 may further include a power button portion 170 and/or a volume button portion 180. Here, only one of the power button portion 170 and the volume button portion 180 may be configured. Through a single button, power may be turned ON or OFF or a volume may be adjusted. For example, the power button portion 170 may be configured using a touch or button pressing method. When a touch or a button is pressed for a predetermined time or more, the power is turned OFF or ON. When a touch or a button is pressed quickly, sound may increase. When a double touch or a double button is pressed, sound may decrease. Here, a method of turning ON or OFF a power or adjusting a volume may be set by the user. As another example, the volume button portion 180 may be configured using a button pressing method and may be configured to include two buttons and to increase or decrease a volume of sound by pressing each button. Here, the volume button portion 180 may be set to turn ON or OFF the power by pressing at least one of the two buttons for a predetermined period of time or more. As another example, the volume button portion 180 may be connected to the lower call-oriented microphone 160 through a single frame. In detail, a single frame formed in a curved shape may be provided along the outer periphery of the body 110. The volume button portion 180 may be provided to one side of the frame provided in an upper portion and the call-oriented microphone 160 may be provided to another side of the frame provided in a lower portion. Here, a button portion may be provided to the call-oriented microphone 160 to connect a call by pressing a button. According to settings, the entire power may be turned OFF or turned ON by pressing the button portion for a predetermined period of time or more.

As described above, according to some example embodiments, it is possible to more effectively amplify sound by providing the microphones 140 and 150 toward the ear band 120. Also, according to some example embodiments, by providing the plurality of microphones 140 and 150 to the ear band 120 at a predetermined distance, it is possible to minimize howling effect when seated on the back of the auricle.

Example embodiments are configured in a form of a sports earphone rather than a conventional hearing aid form and implemented to simultaneously use an earphone function and a hearing aid function. Also, according to example embodiments, waterproof (IPX7) is possible due to characteristics of a hearing aid/earphone with an excellent earbud shape and inner molding.

A digital hearing device with a microphone in an ear band according to another example embodiment may include a body; an ear band including a first extension configured to extend from one side of the body and a second extension configured to surround at least a portion of the first extension along auricle of a user; a first microphone provided to the first extension of the ear band; a second microphone provided to the second extension of the ear band; an ear head configured to protrude inward from the body and to fit into an ear of the user; and a speaker provided to the ear head and configured to amplify sound received from the plurality of microphones to deliver the amplified sound to the user. The body and the ear band may be in a "C" shape.

Here, the first microphone may be provided to face the front based on a face of the user when worn and configured to recognize sound from the front, and the second microphone may be provided to face a back portion or an upper portion of a head of the user when worn and configured to recognize sound from behind.

The digital hearing device with the microphone in the ear band according to another example embodiment may include a configuration of the aforementioned digital hearing device 100 according to an example embodiment and repeated description is omitted.

Figure 5:
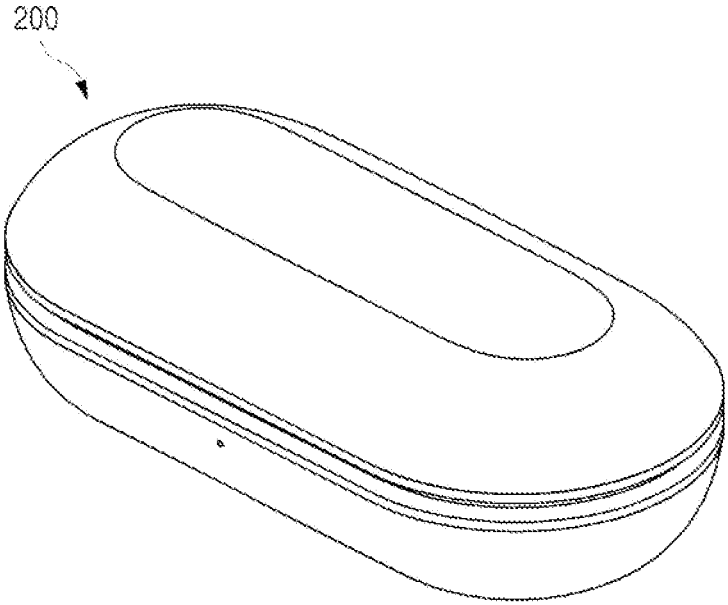
FIG. 5 illustrates a case of a digital hearing device with a microphone in an ear band according to an example embodiment.
Figure 6:
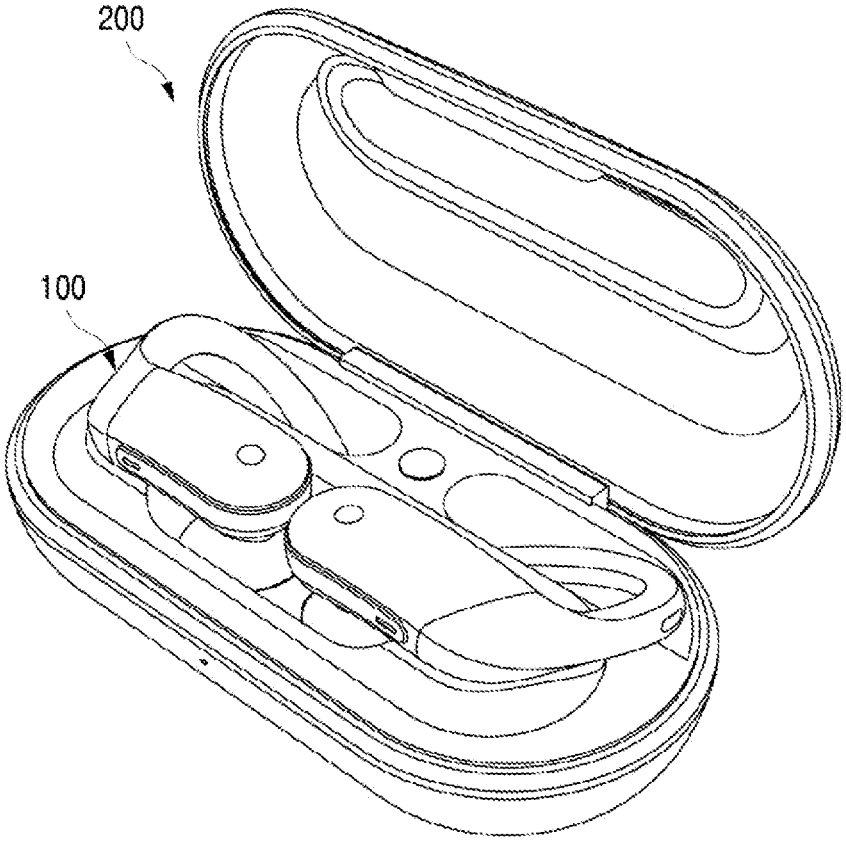
FIG. 6 illustrates a state in which a case of a digital hearing device with a microphone in an ear band is open according to an example embodiment.

FIG. 5 illustrates a case of a digital hearing device with a microphone in an ear band according to an example embodiment, and FIG. 6 illustrates a state in which a case of a digital hearing device with a microphone in an ear band is open according to an example embodiment.

Referring to FIGS. 5 and 6, the digital hearing device 100 according to an example embodiment may further include a case 200 for storage and charging. For example, a single pair of digital hearing devices 100 with microphones in two ear bands may be accommodated in the single case 200. The case 200 may include a battery and may charge the digital hearing device 100. The battery of the case 200 may be charged through a cable.

Figure 7:
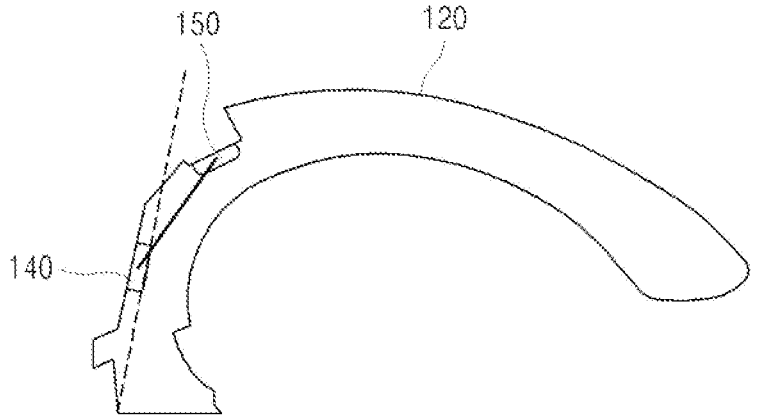
FIG. 7 illustrates an example of a position of a microphone of a digital hearing device with a microphone in an ear band according to an example embodiment.

FIG. 7 illustrates an example of a position of a microphone of a digital hearing device with a microphone in an ear band according to an example embodiment.

Referring to FIG. 7, the digital hearing device 100 according to an example embodiment is in a structure in which two microphones 140 and 150 are positioned toward the ear band 120 to make it possible to listen to sound from front/rear.

Here, by setting a distance between the first microphone 140 and the second microphone 150 positioned toward the ear band 120 to be about 12 mm~15 mm, performance of the two microphones 140 and 150 may be optimized due to algorithm characteristics. Meanwhile, a distance between the first microphone 140 and the second microphone 150 is not limited thereto.

Figure 8:
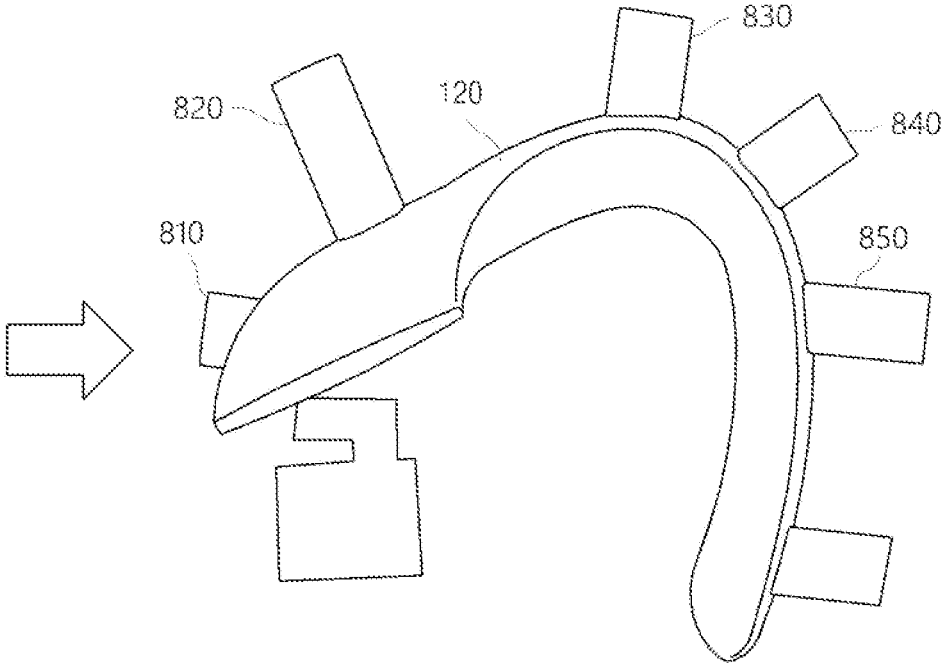
FIG. 8 illustrates an example of a position of a microphone of a digital hearing device with a microphone in an ear band according to an example embodiment.

FIG. 8 illustrates an example of a position of a microphone of a digital hearing device with a microphone in an ear band according to an example embodiment.

Referring to FIG. 8, in the digital hearing device 100 according to an example embodiment, the plurality of microphones 140 and 150 may be provided to be spaced apart from each other. Here, available positions in the ear band 120 may be provided as an example. For example, the first microphone 140 may be provided at a position 820 and the second microphone 150 may be provided at a position 840. As another example, the first microphone 140 may be provided at a position 810 and the second microphone 150 may be provided at a position 850. As described above, the plurality of microphones 140 and 150 may be disposed at positions 810, 820, 830, 840 and 850, respectively.

Figure 9:
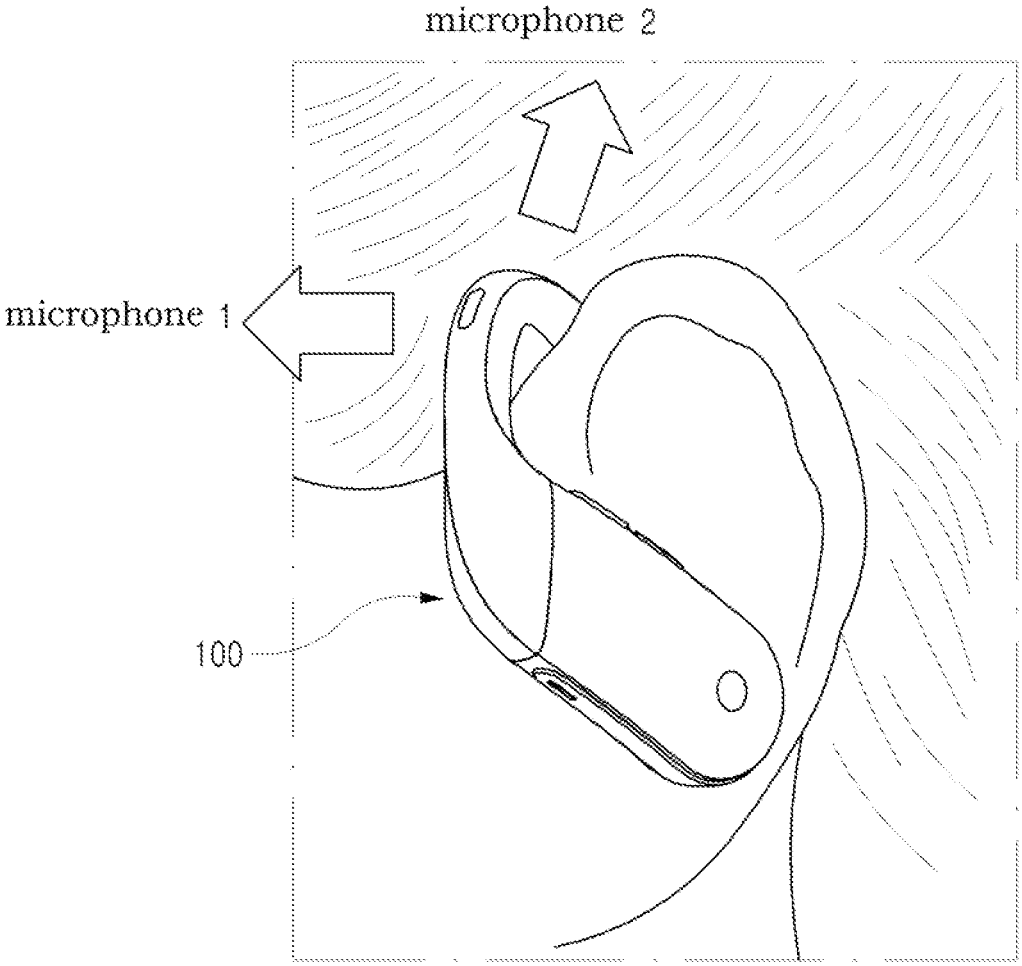
FIG. 9 illustrates an example of wearing a digital hearing device with a microphone in an ear band according to an example embodiment.

FIG. 9 illustrates an example of wearing a digital hearing device with a microphone in an ear band according to an example embodiment.

Referring to FIG. 9, when the digital hearing device 100 according to an example embodiment is worn by the user, a position of the first microphone 140 may be provided to face the front based on the face and a position of the second microphone 150 may be provided to face upward that is a direction of the head. In this manner, howling and sound characteristics may be improved when worn. In particular, the digital hearing device 100 may improve amplification effect of sound by positioning a microphone behind the auricle.

Meanwhile, the conventional hearing aid includes a behind-the-ear (BTE) type, an in-the-ear (ITE) type, an in-the-canal (ITC) type, and a completely-in-canal (CIC) type. The digital hearing device 100 according to an example embodiment refers to a structure in a different type from that of an existing hearing aid and may simultaneously perform a typical earphone function as well as a hearing aid function.

Figure 10:
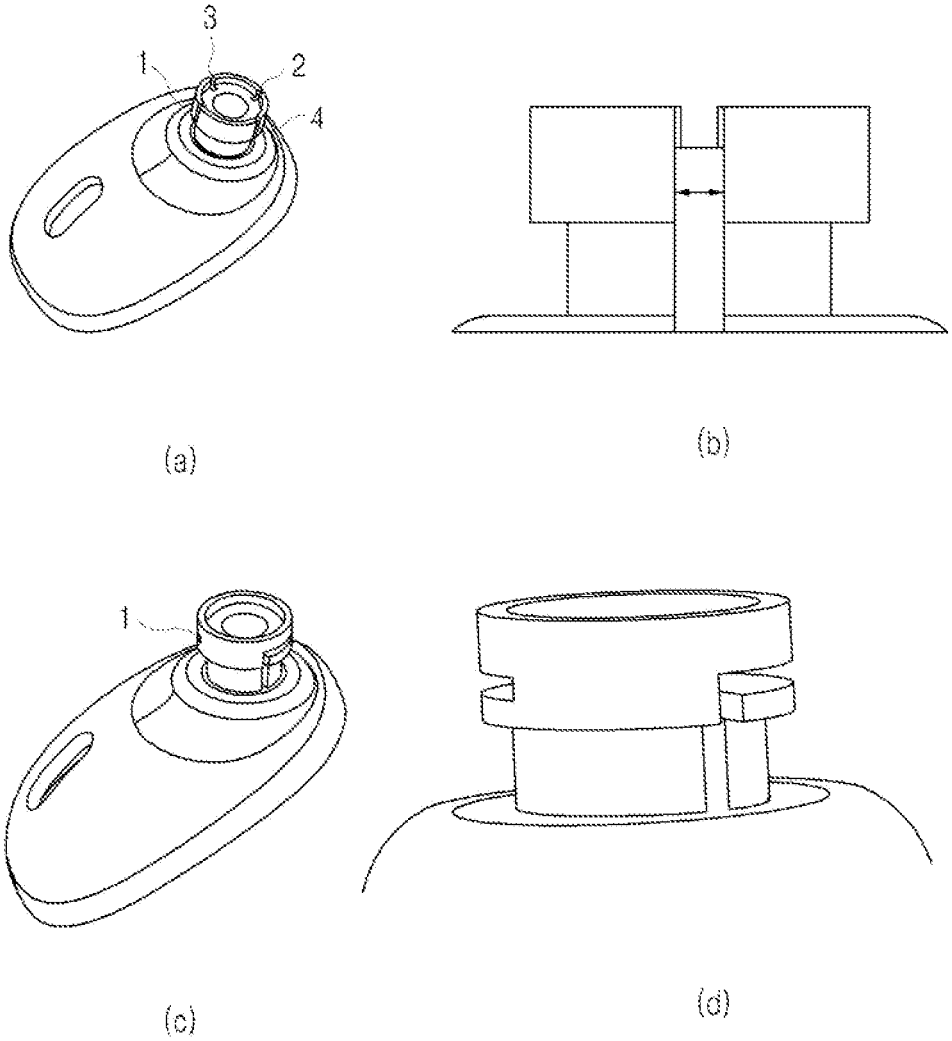
FIG. 10 illustrates a leakage hole of an ear head of a digital hearing device with a microphone in an ear band according to an example embodiment.

FIG. 10 illustrates a leakage hole of an ear head of a digital hearing device with a microphone in an ear band according to an example embodiment.

Referring to FIG. 10, occlusion may be minimized by forming a leakage hole in a nozzle portion of the ear head 130 of the digital hearing device 100 according to an example embodiment.

For example, the ear head 130 may form four leakage holes in a protruding portion of a nozzle-type nozzle portion. The leakage holes may be formed with a longitudinally elongated groove. Alternatively, the longitudinally elongated groove may be formed and then bent and the groove may be formed in a horizontal direction along at least a portion of the outer circumferential surface. Here, sizes of grooves of the four leakage holes may be configured differently. For example, 1, 2, 3 and 4 may be sequentially configured as 0.7 mm, 0.5 mm, 0.4 mm, and 0.3 mm.

Figure 11:
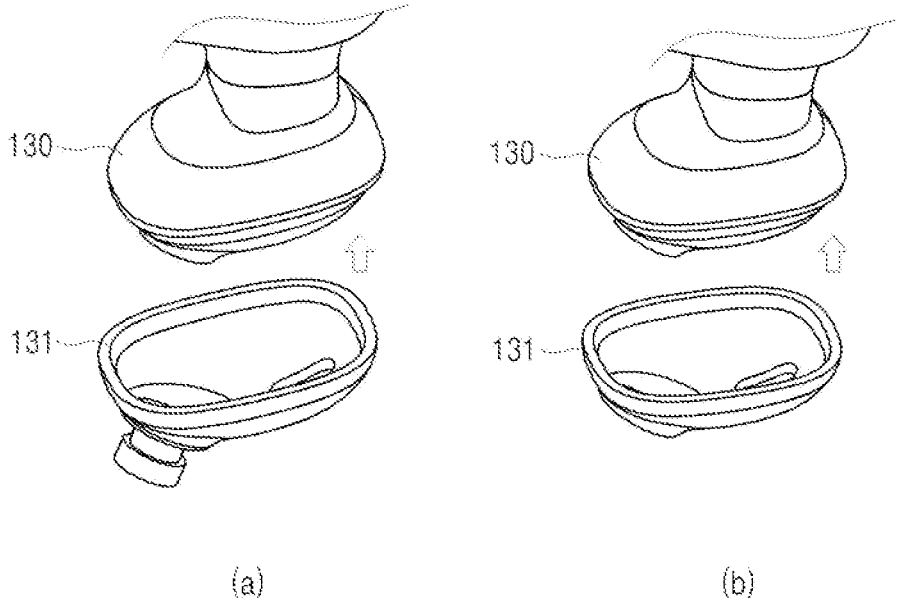
FIG. 11 illustrates an open-type cover or a nozzle-type cover of an ear head of a digital hearing device with a microphone in an ear band according to an example embodiment.

FIG. 11 illustrates an open-type cover or a nozzle-type cover of an ear head of a digital hearing device with a microphone in an ear band according to an example embodiment.

Referring to FIG. 11, the ear head 130 may be configured to be optimally available by combining an open-type or nozzle-type silicone cover. In this case, the ear head 130 may be configured as an open type and, when a silicone cover 131 is coupled to a lower portion of the ear head 130, the ear head 130 may be determined as an open type or a nozzle type according to a shape of the silicone cover 131.

For example, when the silicone cover 131 including a protrusion is coupled to the ear head 130 configured as the open type, the ear head 130 may be used as the nozzle type.

As described above, the example embodiments enable a comfortable mood even in a noisy environment since a direction of a microphone is positioned behind the auricle when being seated in an ear of a user by positioning a position of the microphone behind an ear band and may improve amplification effect of sound. In particular, according to some example embodiments, since a microphone and a speaker are provided at a distance therebetween, it is possible to minimize mutual interference and to maximize an amplification gain of each of the microphone and the speaker.

When it is mentioned that one component is "connected" or "accessed" to another component, it may be understood that the one component is directly connected or accessed to another component or that still other component is interposed between the two components. In contrast, when it is mentioned that one component is "directly connected" or "directly accessed" to another component, it may be understood that there is no intervening component therebetween.

The terms used herein are for describing various example embodiments only, and are not construed to limit the disclosure. The singular forms "a," "an," and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Although the terms "first," "second," and the like are used to explain various components, the components are not limited to such terms. These terms are used only to distinguish one component from another component.

Also, the terms " . . . portion," " . . . module," used herein refer to a unit for processing at least one function or operation, which may be implemented through hardware or software, or combination of hardware and software.

Also, a component of an example embodiment described with reference to each drawing may be implemented to be included in other example embodiments within the scope in which the technical spirit of the disclosure is maintained, without being limitedly applied to the corresponding example embodiment only. Also, although a separate description is omitted, a plurality of example embodiments may be implemented as a single integrated example embodiment.

Also, when describing with reference to the accompanying drawings, like reference numerals refer to like elements throughout and repeated description related thereto is omitted. When it is determined that detailed description of a related known art may unnecessarily obscure the gist of the disclosure, the detailed description is omitted.

While this disclosure includes specific example embodiments, it will be apparent to one of ordinary skill in the art that various alterations and modifications in form and details may be made in these example embodiments without departing from the spirit and scope of the claims and their equivalents. For example, suitable results may be achieved if the described techniques are performed in a different order, and/or if components in a described system, architecture, device, or circuit are combined in a different manner, and/or replaced or supplemented by other components or their equivalents. Therefore, other implementations, other example embodiments, and equivalents are within the scope of the following claims.

What is claimed is:

1. A digital hearing device with a microphone in an ear band, the digital hearing device comprising:

a body;

an ear band configured to extend from one side of the body and to surround at least a portion of auricle of a user;

a plurality of microphones provided to the ear band at predetermined intervals;

an ear head configured to protrude inward from the body and to fit into an ear of the user; and a speaker provided to the ear head and configured to amplify sound received from the plurality of microphones and to deliver the amplified sound to the user.

2. The digital hearing device of claim 1, wherein the body and the ear band are in a "C" shape, and the plurality of microphones is provided to the ear band to face different directions when worn.

3. The digital hearing device of claim 1, wherein the plurality of microphones comprises:

a first microphone provided to face the front based on a face of the user when worn and configured to recognize sound from the front; and a second microphone provided to face a back portion or an upper portion of a head of the user when worn and configured to recognize sound from behind.

4. The digital hearing device of claim 1, further comprising:

a wireless communicator provided to the body and configured to connect to a user terminal through wireless communication; and a controller provided to the body and configured to connect to the user terminal through the wireless communicator and to transmit and receive sound data and a control signal.

5. The digital hearing device of claim 4, further comprising:

a call-oriented microphone provided to the body and configured to recognize a voice signal of the user when a call is connected using the user terminal.

6. The digital hearing device of claim 4, wherein the controller is configured to control the plurality of microphones to operate in at least one mode among a hearing aid mode, a call mode, and an earphone mode, and controls the plurality of microphones to be in an ON state when the hearing aid mode is set and controls the plurality of microphones to be in an OFF state when the call mode or the earphone mode is set.

7. The digital hearing device of claim 4, wherein the controller controls the plurality of microphones to be in an ON state when a hearing aid mode is set, and controls one of the plurality of microphones closest to a mouth of the user to be in an ON state and another microphone to be in an OFF state when a call mode is set.

8. The digital hearing device of claim 4, wherein the controller turns ON/OFF a power of at least one of the plurality of microphones or adjusts an amplification gain of each of the plurality of microphones.

9. The digital hearing device of claim 4, wherein the controller is configured to set an amplification gain of each of the plurality of microphones according to a control signal delivered through an application of a terminal of the user.

10. The digital hearing device of claim 1, wherein the ear head is optionally available by combining an open-type or nozzle-type silicone cover.

11. The digital hearing device of claim 1, wherein the ear head is configured to form at least one leakage hole in a protruding portion of a nozzle-type nozzle portion and to minimize occlusion.

12. A digital hearing device with a microphone in an ear band, the digital hearing device comprising:

a body;

an ear band comprising a first extension configured to extend from one side of the body and a second extension configured to surround at least a portion of the first extension along auricle of a user;

a first microphone provided to the first extension of the ear band;

a second microphone provided to the second extension of the ear band;

an ear head configured to protrude inward from the body and to fit into an ear of the user; and a speaker provided to the ear head and configured to amplify sound received from the plurality of microphones and to deliver the amplified sound to the user, wherein the body and the ear band are in a "C" shape.

13. The digital hearing device of claim 12, wherein:

the first microphone is provided to face the front based on a face of the user when worn and configured to recognize sound from the front, and the second microphone is provided to face a back portion or an upper portion of a head of the user when worn and configured to recognize sound from behind.

* * * * *